US006920652B2

(12) United States Patent
Kiefer et al.

(10) Patent No.: US 6,920,652 B2
(45) **Date of Patent: *Jul. 26, 2005**

(54) TOP FOR STARTING PLATFORM FOR SWIMMING POOL

(75) Inventors: Jack Kiefer, Wadsworth, IL (US); Jonathan Skovronski, Paddock Lake, WI (US)

(73) Assignee: Adolph Kiefer & Associates, Inc., Zion, IL (US)

( * ) Notice: Subject to any disclaimer, the term of this patent is extended or adjusted under 35 U.S.C. 154(b) by 373 days.

This patent is subject to a terminal disclaimer.

(21) Appl. No.: 10/323,499

(22) Filed: Dec. 18, 2002

(65) Prior Publication Data

US 2003/0134715 A1 Jul. 17, 2003

Related U.S. Application Data

(63) Continuation of application No. 10/047,148, filed on Jan. 14, 2002, now Pat. No. 6,523,188.

(51) Int. Cl.[7] ..... E04H 4/00

(52) U.S. Cl. ..... 4/496; 4/504; 472/85; 482/26; 482/30

(58) Field of Search ..... 4/496, 504, 656, 4/637, 640, 631; 472/85, 128; 482/26, 55, 30, 31, 32; D23/287, 290

(56) References Cited

U.S. PATENT DOCUMENTS

| | | | | | |
|---|---|---|---|---|---|
| 2,963,294 | A | | 12/1960 | Buck | |
| 3,035,837 | A | | 5/1962 | Austin | |
| D193,382 | S | * | 8/1962 | Goetz | D32/53.1 |
| 3,178,333 | A | | 4/1965 | Gabrielsen et al. | |
| D202,546 | S | | 10/1965 | French | |
| 3,861,674 | A | | 1/1975 | Buck, Jr. | |
| 3,916,214 | A | | 10/1975 | Coble et al. | |
| D240,811 | S | | 8/1976 | Beall, Jr. | |
| 4,475,016 | A | | 10/1984 | Berger | |
| 4,509,226 | A | * | 4/1985 | Allison et al. | 15/257.06 |
| 4,967,433 | A | * | 11/1990 | Neal | 5/655.9 |
| 5,139,139 | A | * | 8/1992 | Goetz | 206/229 |
| 5,290,210 | A | * | 3/1994 | Hand et al. | 482/51 |
| 5,916,031 | A | | 6/1999 | Casillan | |
| D464,699 | S | | 10/2002 | Brice | |
| 2004/0199990 | A1 | * | 10/2004 | Weimer et al. | 4/496 |

FOREIGN PATENT DOCUMENTS

EP 428804 A1 5/1991

OTHER PUBLICATIONS

Photograph showing top plan of Paragon starting platform top, undated, admitted prior art.

* cited by examiner

*Primary Examiner*—Khoa D. Huynh
(74) *Attorney, Agent, or Firm*—Wood, Phillips, Katz, Clark & Mortimer

(57) ABSTRACT

A top for a starting platform at one end of a swimming pool has an upper surface, which is adapted to support both feet of a swimmer in a starting position, and a lower surface, at which the top is mountable so that the upper surface slants downwardly and frontwardly. Ribs on the upper surface slant downwardly and laterally and channels between the ribs slant similarly so as to drain water from the upper surface. Along each lateral edge, an upper trough and a lower trough facilitate grasping by one hand of such a swimmer. The upper trough receives water drained by some of the channels. The front edge is connected to each lateral edge by a unitary grip, which a swimmer in a different position can grasp with one hand.

10 Claims, 7 Drawing Sheets

TOP FOR STARTING PLATFORM FOR SWIMMING POOL

CROSS-REFERENCE TO RELATED APPLICATION

This application is a continuation of U.S. patent application Ser. No. 10/047,148, which was filed on Jan. 14, 2002 now U.S. Pat. No. 6,523,188.

FIELD OF THE INVENTION

This invention pertains to an improved top for a starting platform, which may be also called a starting block, for one end of a swimming pool. In a preferred embodiment, the improved top can be unitarily molded from an engineering polymer, such as linear low-density polyethylene.

BACKGROUND OF THE INVENTION

In a swimming meet, each swimmer starts at a starting platform, which may be also called a starting block, at one end of a swimming pool. Several models of such starting platforms are available commercially from Kiefer Pool Equipment Co. of Zion, Ill., as illustrated and described briefly on page 2 of its 2002 Product Guide, in which such starting platforms are called starting blocks.

Typically, as exemplified by those models, a starting platform comprises a base, stand, or pedestal, to which a top is mounted so that its upper surface is horizontal or so that its upper surface is sloped slightly (e.g. not more than 10° from horizontal) from the back edge of the top toward its front edge. Moreover, the upper surface of the top is covered with an adhesively adhered, slip-resistant cover.

In each of those models, a tubular frame is mounted along the lateral edges of the top, for a swimmer in a starting position for any of numerous strokes including a front crawl to grasp with each hand. Moreover, a front portion of the tubular frame extends below the front edge of the top, for a swimmer in a starting position for a backstroke to grasp with both hands.

SUMMARY OF THE INVENTION

This invention provides, for a starting platform for one end of a swimming pool, an improved top having an upper surface and a lower surface. The upper surface is adapted to support both feet of a swimmer in a starting position, e.g., a starting position for a front crawl. The improved top is mountable at the lower surface to a base, stand, or pedestal, e.g., via screws or other fasteners. In a preferred embodiment, the improved top can be unitarily molded from an engineering polymer, such as polypropylene.

The upper surface defines an array of ribs and defines channels between the ribs. The ribs are configured so that, if improved top is mounted so that its upper surface slants downwardly from its back edge toward its front edge, each rib slants downwardly and laterally and each channel slants similarly to drain water from the upper surface downwardly and laterally. Preferably, at least some of the ribs are configured as chevrons, which point toward the back edge.

Preferably, along at least part of each lateral edge, the lower surface defines a trough, which facilitates grasping of said lateral edge. Preferably, along at least part of each lateral edge, the upper surface defines a trough, which facilitates grasping of said lateral edge and which is adapted to receive and to drain water received by at least some of the channels.

This invention also provides an improved starting platform comprising the improved top, as described above, which is mounted so that the upper surface slants downwardly from the back edge toward the front edge, so that each rib slants downwardly and laterally on each side of an imaginary line bisecting the upper surface between the lateral edges, and so that each channel slants similarly.

BRIEF DESCRIPTION OF THE DRAWINGS

In FIGS. 1 and 2, the swimmers are illustrated as phantoms. A pedestal of the starting platform is illustrated in broken lines.

DETAILED DESCRIPTION OF THE ILLUSTRATED EMBODIMENT

Figure 1:
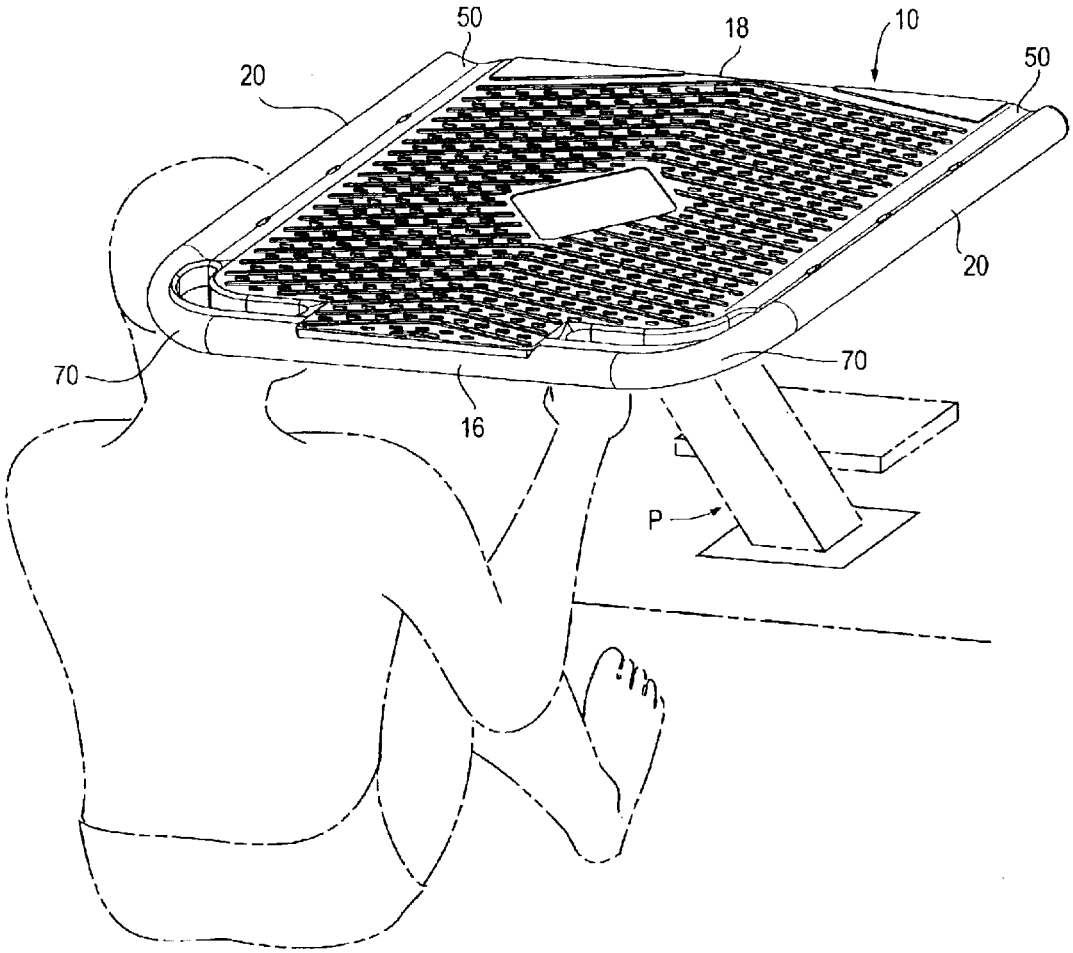
FIG. 1 is a perspective view illustrating a starting platform comprising a top embodying this invention, as used by a swimmer in a starting position for a front crawl.
Figure 2:
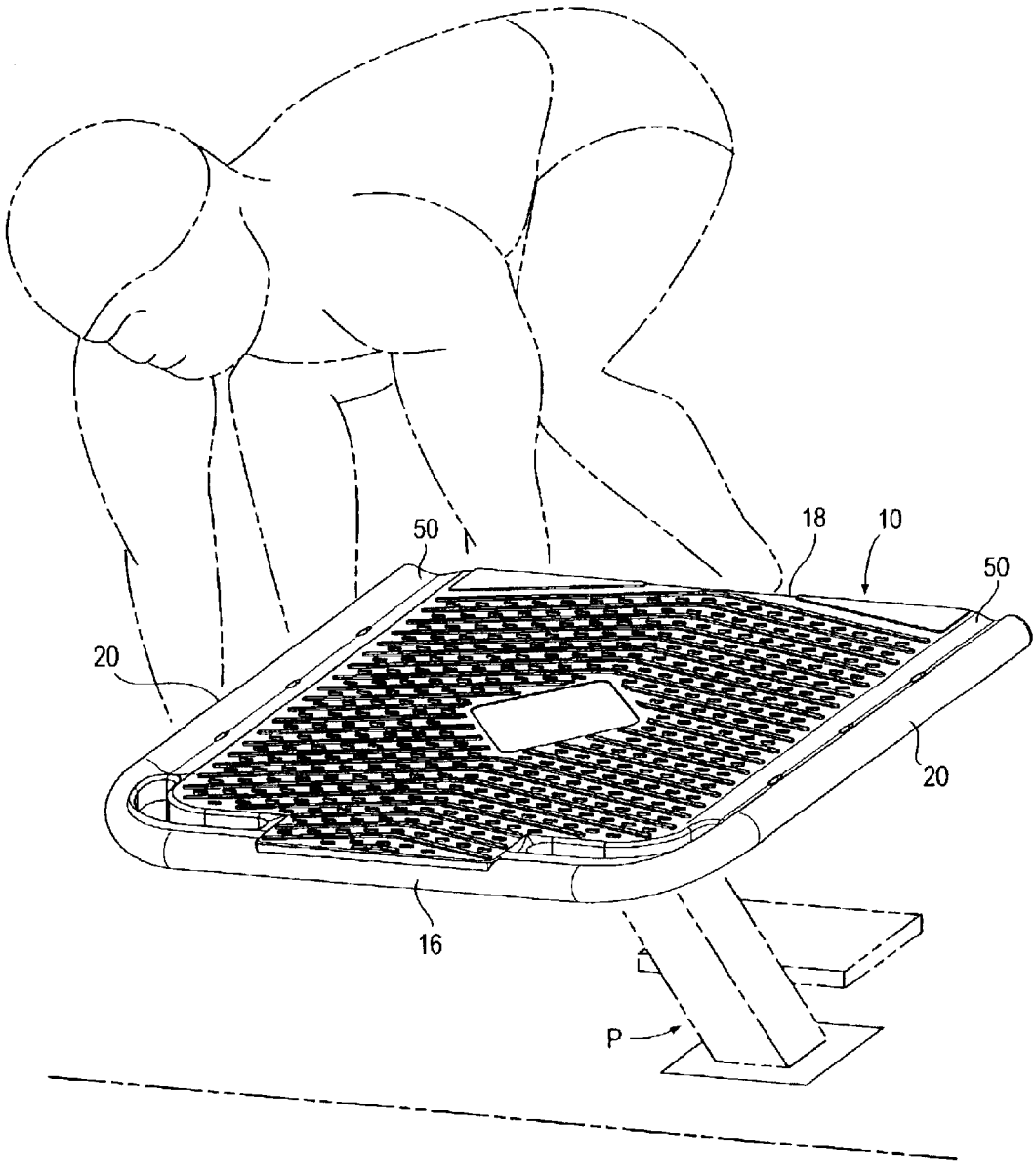
FIG. 2 is a perspective view illustrating the same platform, as used by a swimmer in a starting position for a back crawl.
Figure 3:
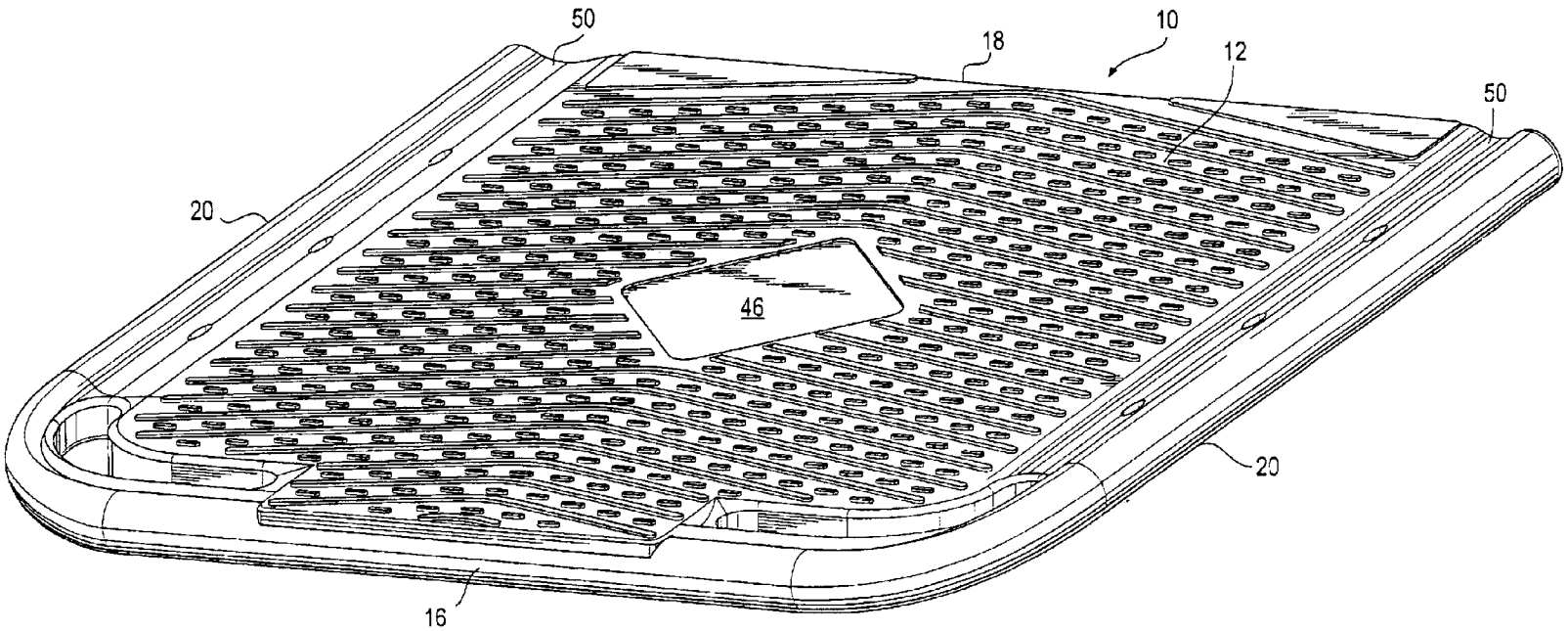
FIG. 3, on a larger scale compared to FIGS. 1 and 2, is a perspective view of the starting platform top, as taken from an upper, front, right side vantage.
Figure 4:
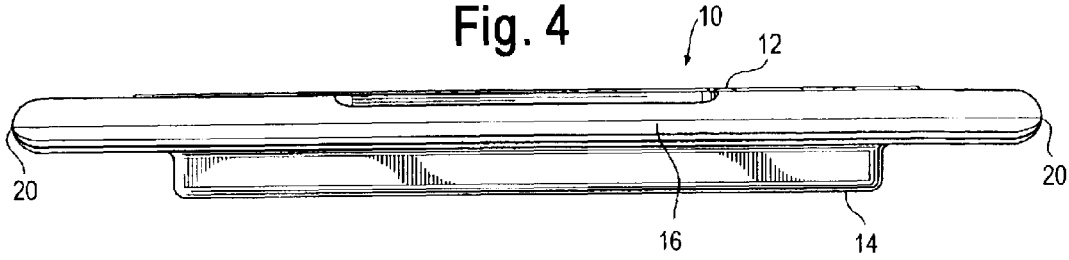
FIG. 4, on a similar scale, is a front view of the starting platform top.
Figure 5:
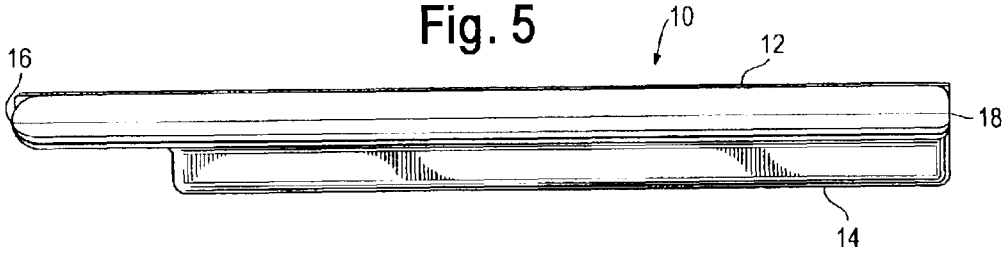
FIG. 5, on a similar scale, is a side view of the starting platform top, as seen from the right side, the left side being a mirror image of the right side.
Figure 6:
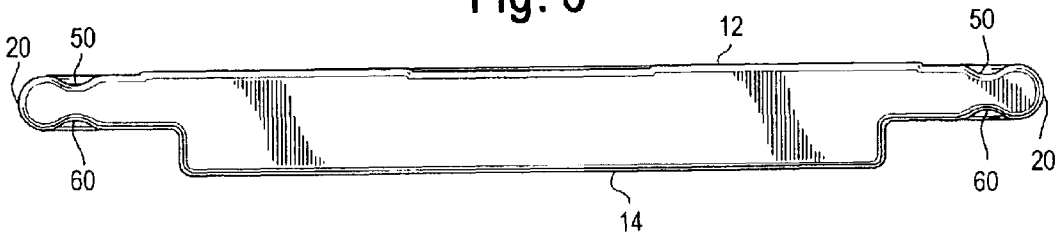
FIGS. 6, 7, and 8, on a similar scale, respectively are back, top, and bottom views of the starting platform top.
Figure 7:
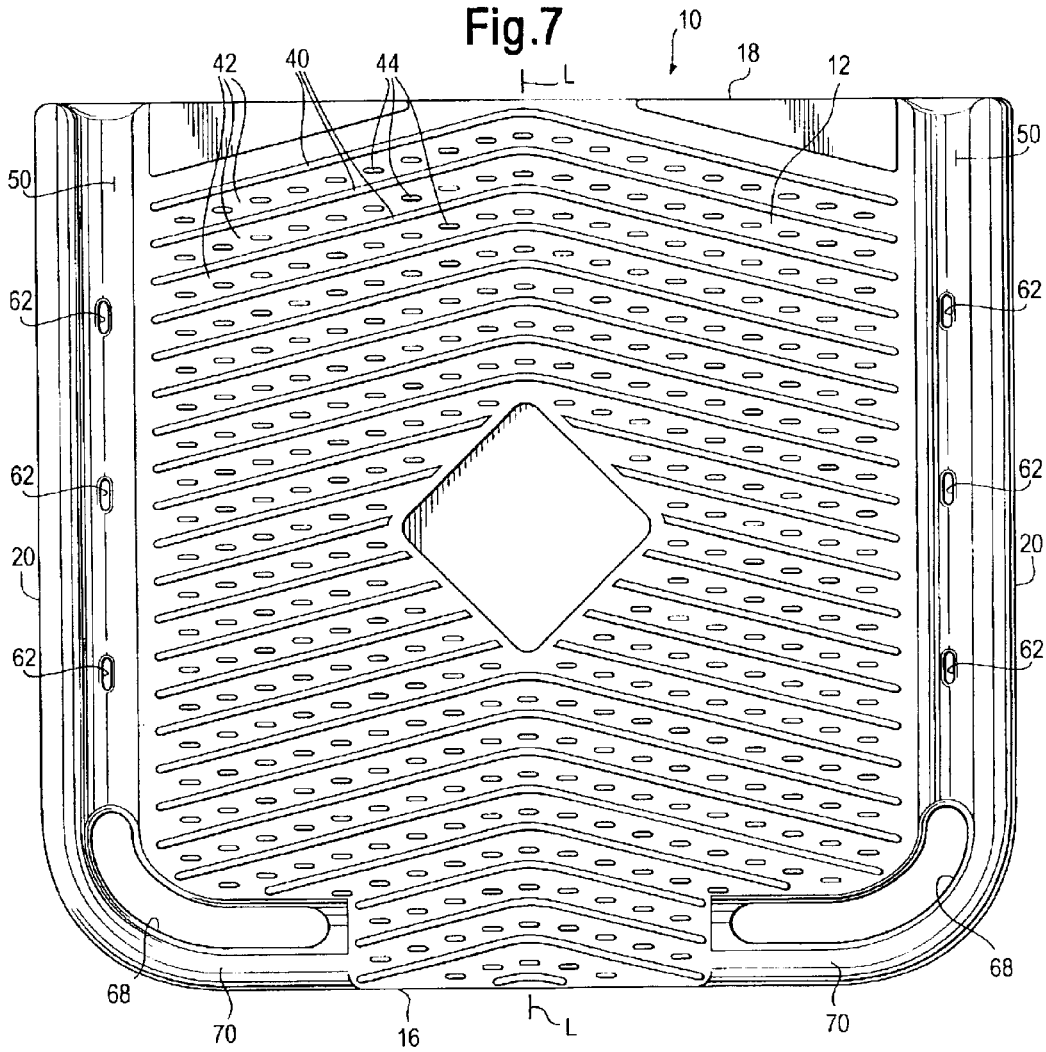
Figure 8:
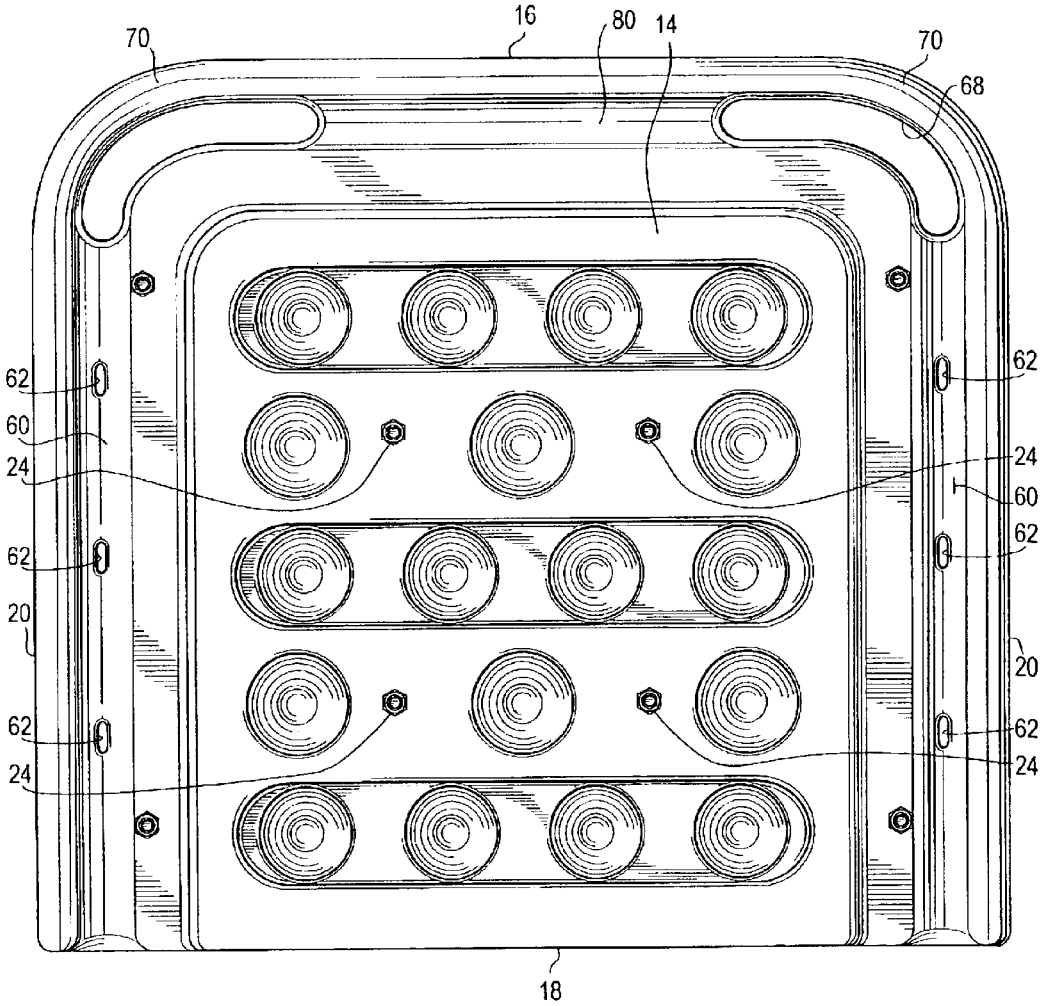
Figure 9:
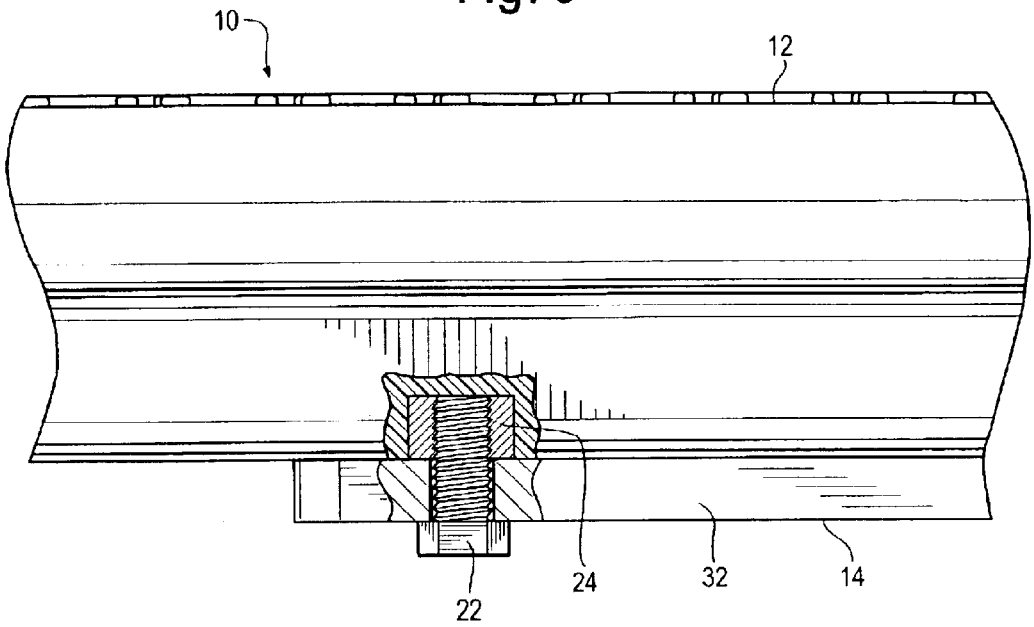
FIG. 9, on a larger scale compared to FIGS. 3 through 8, is a fragmentary, sectional detail, which illustrates how the starting platform top is fastened to the starting platform pedestal.

As illustrated in FIGS. 1 and 2, a starting platform for one end of a swimming pool has a pedestal P and an improved top 10, which is fastened onto the pedestal P and which has an upper surface 12, a lower surface 14, a front edge 16, a back edge 18, and two lateral edges 20. The upper surface 12 is adapted to support both feet of a swimmer in a starting position, e.g., a starting position for a front crawl. Each lateral edge 20 is adapted to be grasped by one hand of the swimmer in the starting position. The improved top 10 is molded unitarily from an engineering polymer, such as polypropylene, so as to be textured on the top surface 14.

The improved top 10 is mounted at the lower surface 14 to the pedestal P, via screws 22 (one shown) passing through a plate 32 of the pedestal P, through the lower surface 14, into the improved top 10, which has embedded, threaded receptacles 24 for such screws. Details of such pedestals, screws, and receptacles are known and are outside the scope of this invention. The improved top 10 is mounted so that the upper surface 12 is horizontal or, preferably, so that the upper surface 12 is sloped slightly (e.g. not more than 10° from horizontal) from the back edge 18 toward the front edge 16.

The upper surface 12 defines an array of ribs 40, channels 42 between the ribs 40, and nubs 44 within the channels 42. As illustrated, the ribs 40 are continuous and the channels 42 are continuous. The ribs 40 are configured so that, if improved top 10 is mounted so that the upper surface 12 slants downwardly from the back edge 18 toward the front edge 16, each rib 40 slants downwardly and laterally on each side of an imaginary line L bisecting the upper surface 12 between the lateral edges 20 and each channel 42 slants similarly to drain water from the upper surface 12 downwardly and laterally. Except where the ribs 40 are interrupted by an indicia-receiving area 46 on the upper surface 12, the ribs 40 are configured as chevrons pointing toward the back edge 18. Because the improved top 10 is molded so as to be textured on the upper surface 12, because the ribs 40, the channels 42, and the nubs 44 tend to provide traction for a swimmer's feet, and because the channels 42 drain water from the upper surface 12, the upper surface 12 tends to be slip-resistant, even when water drips or splashes onto the upper surface 12, particularly but not exclusively if the upper surface 12 is sloped, as mentioned above.

Along a substantial part of each lateral edge 20, the upper surface 12 defines an upper trough 50, which facilitates grasping of said lateral edge 20 and which is adapted to receive and to drain water drained by many of the channels 42, and the lower surface 14 defines a lower trough 60, which also facilitates grasping of said lateral edge 20. Along each lateral edge 20, the upper trough 50 communicates with the lower trough 50, via several slots 62, through which water can drain.

Where the front edge 16 is connected to each lateral edge 20, the improved top 10 has a curved aperture 68 defining a unitary grip 70. Along each lateral edge 20, water can drain from the upper trough 50 via the curved aperture 68. As illustrated in FIG. 2, each unitary grip 70 is adapted to be grasped by one hand of a swimmer in a starting position for a back crawl. Along a substantial part of the front edge 16, between the unitary grips 70, the lower surface 14 defines a lower trough 80, which facilitates grasping of the front edge 16.

Because of the upper and lower troughs 50, 60, because of the unitary grips 70, and because of the lower trough 80, there is no need for a tubular frame mounted along the lateral edges 20, for a swimmer in a starting position for any of numerous strokes including a front crawl to grasp with each hand, or for a frame portion extending below the front edge 16, for a swimmer in a starting position for a backstroke to grasp with both hands.

What is claimed is:

1. A starting platform for one end of a swimming pool, a top having a front edge, a back edge, and two lateral edges, each of which is adapted to be grasped by one hand of a swimmer in a starting position, the top having an upper surface, which is adapted to support both feet of a swimmer in a starting position for a race, the top having a lower surface, at which the top is mountable to a base, stand, or pedestal, the upper surface defining an array of continuous ribs and defining continuous channels between the ribs, the ribs being configured so that, if the top is mounted so that the upper surface slants downwardly from the back edge toward the front edge, each rib slants downwardly and laterally and each channel slants similarly to drain water from the upper surface downwardly and laterally, wherein the top is unitary and wherein, along at least part of each lateral edge, the lower surface defines a trough, which facilitates grasping of said lateral edge.

2. The top of claim 1 wherein the front edge is connected to each of the lateral edges by a unitary grip, which is adapted to be grasped by one hand of a swimmer in a different position.

3. The top of claim 1 wherein at least some of the ribs are configured as chevrons pointing toward the back edge.

4. A starting platform for one end of a swimming pool, a top having a front edge, a back edge, and two lateral edges, each of which is adapted to be grasped by one hand of a swimmer in a starting position, the top having an upper surface, which is adapted to support both feet of a swimmer in a starting position for a race, the top having a lower surface, at which the top is mountable to a base, stand, or pedestal, the upper surface defining an array of continuous ribs and defining continuous channels between the ribs, the ribs being configured so that, if the top is mounted so that the upper surface slants downwardly from the back edge toward the front edge, each rib slants downwardly and laterally and each channel slants similarly to drain water from the upper surface downwardly and laterally, wherein the top is unitary and wherein, along at least part of each lateral edge, the upper surface defines a trough, which facilitates grasping of said lateral edge and which is adapted to receive and to drain water drained by at least some of the channels.

5. The top of claim 4 wherein the front edge is connected to each of the lateral edges by a unitary grip, which is adapted to be grasped by one hand of a swimmer in a different position.

6. The top of claim 4 wherein at least some of the ribs are configured as chevrons pointing toward the back edge.

7. A starting platform for one end of a swimming pool, a top having a front edge, a back edge, and two lateral edges, each of which is adapted to be grasped by one hand of a swimmer in a starting position, the top having an upper surface, which is adapted to support both feet of a swimmer in a starting position for a race, the top having a lower surface, at which the top is mountable to a base, stand, or pedestal, the upper surface defining an array of continuous ribs and defining continuous channels between the ribs, the ribs being configured so that, if the top is mounted so that the upper surface slants downwardly from the back edge toward the front edge, each rib slants downwardly and laterally and each channel slants similarly to drain water from the upper surface downwardly and laterally, wherein the top is unitary, wherein, along at least part of each lateral edge, the upper surface defines a trough, which facilitates grasping of said lateral edge and which is adapted to receive and to drain water drained by at least some of the channels, and wherein, along at least part of each lateral edge, the lower surface defines a trough, which also facilitates grasping of said lateral edge.

8. The top of claim 7 wherein the front edge is connected to each of the lateral edges by a unitary grip, which is adapted to be grasped by one hand of a swimmer in a different position.

9. The top of claim 7 wherein at least some of the ribs are configured as chevrons pointing toward the back edge.

10. A starting platform comprising the top of any preceding claim wherein the top is mounted so that the upper surface slants downwardly from the back edge toward the front edge, so that each rib slants downwardly and laterally on each side of an imaginary line bisecting the upper surface between the lateral edges, and so that each channel slants similarly.

* * * * *